United States Patent [19]

Sasaki et al.

[11] Patent Number: 4,997,752

[45] Date of Patent: Mar. 5, 1991

[54] LIGHT-SENSITIVE SILVER HALIDE PHOTOGRAPHIC MATERIAL

[75] Inventors: Masao Sasaki, Hadano; Kaoru Onodera, Sagamihara, all of Japan

[73] Assignee: Konica Corporation, Tokyo, Japan

[21] Appl. No.: 480,360

[22] Filed: Feb. 15, 1990

Related U.S. Application Data

[63] Continuation of Ser. No. 186,941, Apr. 27, 1988, abandoned.

[30] Foreign Application Priority Data

Apr. 28, 1987 [JP] Japan ..... 62-105783

[51] Int. Cl.[5] ..... G03C 1/34; G03C 1/37

[52] U.S. Cl. ..... 430/611; 430/567; 430/607; 430/613

[58] Field of Search ..... 430/567, 607, 611, 613, 430/489, 490

[56] References Cited

U.S. PATENT DOCUMENTS 4,224,403 9/1980 Toda et al. ..... 430/537

4,452,882 6/1984 Akimura et al. ..... 430/568

*Primary Examiner*—Hoa Van Le

*Attorney, Agent, or Firm*—Finnegan, Henderson, Farabow, Garrett, and Dunner

[57] ABSTRACT

A silver halide photographic light-sensitive material prevented from rottenness or decomposition by bacteria or mold without degradation of photographic properties such as sensitivity and fog. The silver halide photographic light-sensitive material has a photographic constituent layer containing at least one silver halide emulsion layer, and the silver halide grains contained in the emulsion layer comprises not less than 90 mole % of silver chloride. The photographic constituent layer contains at least one organic compound capable of forming a compound having a solubility product Ksp of not more than $1\times10^{-11}$ with a silver ion, and at least one compound selected from the group of the compounds having the following Formula I, II, III or IV:

Formula I

Formula II

Formula III

Formula IV

12 Claims, No Drawings

LIGHT-SENSITIVE SILVER HALIDE PHOTOGRAPHIC MATERIAL

This application is a continuation of application No. 07/186,941 filed Apr. 27, 1988, now abandoned.

FIELD OF THE INVENTION

The present invention relates to a light-sensitive silver halide photographic material which is so improved as to be restrained from the increase in fog as well as from the decline of its photographic speed even in its rapid processing, and is prevented satisfactorily from the rottenness or decomposition due to bacteria or mold even in its manufacture.

BACKGROUND OF THE INVENTION

In recent years, there has been a growing demand for light-sensitive silver halide photographic materials capable of being rapidly processed to form high-quality images.

The processing of light-sensitive silver halide photographic materials is usually performed continuously in the automatic processor that is installed in each photofinishing laboratory, but for the improvement of photofinishing service to customers, the processing of the accepted light-sensitive materials and return of photofinished prints therefrom to customers within the day the light-sensitive materials were accepted has been required, and further, in nowadays, even quicker return of them in the order of several hours to customers has now been required. Also from the standpoint that to shorten the processing time is to improve the productivity, enabling the reduction in cost, the development of rapid processing is urgently needed.

To accomplish the rapid processing, an approach thereto is made from both aspects of light-sensitive materials and processing solutions. As for color development, attempts have been made to use a high temperature, a high pH and a high color developing agent concentration, and further the addition of additives such as a development accelerator and the like is also known. Examples of the development accelerator include the 1-phenyl-3-pyrazolidone as described in British Patent No. 811,185, the N-methyl-p-aminophenol as described in U.S. Pat. No. 2,417,514, the N,N,N',N'-tetramethyl-p-phenylenediamine as described in Japanese Patent Publication Open to Public Inspection (hereinafter referred to as Japanese Patent O.P.I. Publication) No. 15554/1975, and the like. However, these methods are unable to accomplish any sufficient processing rapidity and liable to deteriorate light-sensitive materials' characteristics in such a way as increasing their fog.

On the other hand, it is well-known that the configuration, size and composition of the silver halide grain of a silver halide emulsion to be used in a light-sensitive material largely affect the developing speed, and particularly the silver halide composition is significant—a significantly high developing speed is obtained particularly when a high chloride-containing silver halide is used.

A light-sensitive material is produced generally through the preparation of its emulsion of a silver halide dispersed in an aqueous gelatin solution in the manufacturing process. The aqueous gelatin solution is known to be decomposed or rotten by being subjected to the action of bacteria, mold or the like. For example, in the manufacture of a photographic material, an aqueous gelatin solution containing photographic raw component materials, if allowed to stand in the gel or sol condition for a long period of time, becomes rotten or decomposed, leading to lowering its viscosity when used as a coating liquid, deteriorating the physical strength of the coated layer and bringing a coating trouble (e.g., comets) which is considered due to the decomposed product. These drawbacks have become serious problems in the rapid coating particularly for the mass production in recent years.

For the purpose of restraining such the rottenness or decomposition by bacteria, mold, etc., in a gelatin solution, various fungicides have been disclosed such as those in Japanese Patent O.P.I. Publication Nos. 27424/1979, 157244/1982, 84237/1984, 226344/1984, 263938/1985, 233743/1986, and the like.

We further investigated the problem by the application of various fungicides disclosed in the above publications to a silver halide light-sensitive material comprising a high silver chloride-content silver halide. As a result, it has become apparent that, as compared to silver chlorobromide-type conventional ones, the light-sensitive material is significant in the fog density increase as well as in the desensitization, and in addition, when processed continually over a long period, tends to show a significant desensitization and fog increase considered due to the fungicide dissolved out into its processing solution.

As a result of our various investigations for solving the above problem, it has now been found that by adding a certain restraining compound further to the above fungicide-added system, the fog density can be restrained and the sensitivity decline can be lessened without adversely affecting the processing rapidity, fungicidal effect, and the like, and thus the present invention has been completed.

SUMMARY OF THE INVENTION

It is therefore an object of the present invention to provide a light-sensitive silver halide photographic material which is so improved as to be restrained from the increase in fog as well as from the decline of its sensitivity even in its rapid processing, and prevented satisfactorily from the rottenness or decomposition due to bacteria or mold even in its manufacture.

The above object of the present invention is accomplished by a light-sensitive silver halide photographic material comprising a support having thereon a photographic constituent layer including at least one silver halide emulsion layer, in which said silver halide emulsion layer contains silver halide grains whose silver chloride content is not less than 90 mole % and said photographic constituent layer contains at least one first compound selected from the group of organic compounds capable of forming a compound having a solubility product (Ksp) of not more than $1\times10^{-11}$ with a silver ion and at least one second compound selected from the group of compounds having the following Formulas I, II, III and IV.

Formula I

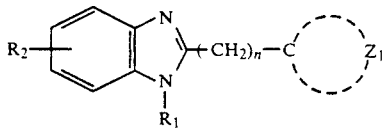

-continued

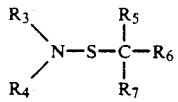

Formula II

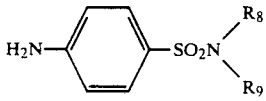

Formula III

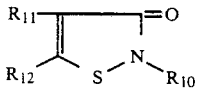

Formula IV

In Formulas I through IV, $R_1$ is a hydrogen atom, an alkyl or aryl group; $R_2$ is a hydrogen atom, a halogen atom, an alkyl, aryl, nitro, carboxy, sulfo, sulfamoyl, hydroxy, alkoxy or thiazolyl group; $Z_1$ is a group of non-metal atoms necessary to form a thiazoline ring; $R_3$ and $R_4$ each is an alkyl, aryl, —COR, or

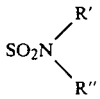

group, wherein R, R′ and R″ each is an alkyl or aryl group, provided that the $R_3$ and $R_4$ are allowed to form a ring together with the nitrogen atom; $R_5$, $R_6$ and $R_7$ each is a halogen atom or an alkyl group; $R_8$ and $R_9$ each is a hydrogen atom, an alkyl, aryl or nitrogen-containing heterocyclic group; $R_{10}$ is a hydrogen atom, an alkyl, cycloalkyl, alkenyl, aryl, heterocyclic, alkylaminocarbonyl, arylaminocarbonyl, alkylaminosulfonyl or arylaminosulfonyl group; $R_{11}$ and $R_{12}$ each is a hydrogen atom, a halogen atom, an alkyl, cycloalkyl, aryl, cyano, alkylthio, arylthio, alkylsulfonyl, alkylsulfonyloxy or heterocyclic group, provided that the $R_{11}$ and $R_{12}$ are allowed to form a ring together.

In this invention, at least one layer of silver halide emulsion layers contains silver halide grains whose silver chloride content is not less than 90 mole %.

The silver chloride content of the silver halide grains of this invention is not less than 90 mole %, preferably not less than 95 mole %, and most preferably not less than 99 mole %. And it is desirable that the silver bromide content is not more than 5 mole % and the silver iodide content is not more than 0.5 mole %.

The silver halide grains of this invention may be used alone or in a mixture with other silver halide grains different in the composition, and may also be used in a mixture with silver halide grains whose silver chloride content is less than 10 mole %.

In the silver halide emulsion layer containing silver halide grains whose silver chloride content is not less than 90 mole %, the proportion of the silver halide grains containing not less than 90 mole % silver chloride to the whole silver halide grains contained in the emulsion layer is not less than 60% by weight, and preferably not less than 80% by weight.

The composition of the silver halide grain of this invention is allowed to be of either a homogeneous structure from the inside through the outside or a heterogeneous structure with the inside and outside different in the composition. Where the inside and outside of the grain differ in the composition, the composition may vary either continuously or discontinuously.

The grain size range of the silver halide grains of this invention, although not particularly restricted, when taking into account the processing rapidity and other photographic characteristics such as the sensitivity, is preferably from 0.2 to 1.6 μm, and more preferably from 0.25 to 1.2 μm. The above grain size can be measured by any one of various measuring methods generally known to those skilled in the art. Typical methods are described in Loveland 'Analytical Methods for Grain Sizes', A.S.T.M. Symposium on Light Microscopy. pp. 94–122, 1955, and Mees and James 'Theory of the Photographic Process' 3rd. ed., Sec. 2, Macmillan, 1966.

The grain size may be measured by using either a projection area or a diameter's approximate value of the grain. If the silver halide grains are of a substantially uniform configuration, the grain size distribution thereof can be fairly precisely expressed in terms of the diameter or projection area.

The silver halide grains of this invention may be either polydisperse of monodisperse, but are preferably monodisperse silver halide grains which, in the silver halide grain size distribution thereof, have a coefficient of variation of not more than 0.22, and more preferably not more than 0.15, wherein the coefficient of variation is a coefficient representing the width of the grain size distribution, and defined by the following formula:

$$\text{Coefficient of variation } (S/r) = \frac{\text{Standard deviation of grain size distribution}}{\text{Average grain size}}$$

$$\text{Standard deviation of grain size distribution } (S) = \sqrt{\frac{\Sigma (r - ri)^2 ni}{\Sigma ni}}$$

$$\text{Average grain size } (r) = \frac{\Sigma niri}{\Sigma ni}$$

wherein ri represents each individual grain size, and ni is the number of grains. The term 'grain size' used herein, in the case of a spherical silver halide grain, means the diameter thereof and, in the case of a cubic or non-spherical grain, means the diameter of a circular image corresponding in the area to the projection image thereof.

The silver halide grain to be used in this invention can be of any arbitrary configuration. A preferred example of the configuration is a cube having a crystal {100} face. Also the silver halide grain may be prepared to be in the octahedral, tetradecahedral or dodecahedral form in accordance with those methods as described in U.S. Pat. Nos. 4,183,756, 4,225,666, Japanese Patent O.P.I. Publication No. 26589/1980, Japanese Patent Examined Publication No. 42737/1980, and the like, and J. Photogr. Sci., 21, 39 (1973).

The silver halide grain to be used in this invention, by the addition of metal ions thereto in the course of being formed and/or grown by using a cadmium salt, zinc salt, lead salt, thalium salt, iridium salt or its complex salt, rhodium salt or its complex salt, or iron salt or its complex salt, can contain such metal ions in the inside and/or on the surface thereof and, by being allowed to stand in an appropriate reductive atmosphere, may be provided in the inside and/or on the surface thereof with a reduction sensitization nucleus.

The silver halide grain to be used in the emulsion of this invention is preferably a grain wherein a latent image is formed mainly on the surface thereof.

The emulsion of this invention may be chemically sensitized in usual manner. That is, the sensitization can be carried out by using alone or in combination the sulfur sensitization method, which uses active gelatin or a compound containing sulfur that is capable of reacting with silver ions; the selenium sensitization method, which uses a selenium compound; the reduction sensitization method, which uses a reductive material; the noble metal sensitization method, which uses a compound of gold or of other noble metal; and the like.

In this invention, as the chemical sensitizer, for example, chalcogen sensitizers may be used, and of these the sulfur sensitizer and selenium sensitizer are preferred. Examples of the sulfur sensitizer include, e.g., thiosulfates, allylthiocarbazide, thiourea, allylisothiocyanates, cystine, p-toluenthiosulfonates, and rhodanine. And those sulfur sensizers as described in U.S. Pat. Nos. 1,574,944, 2,410,689, 2,278,947, 2,728,668, 3,501,313, and 3,656,955, West German OLS Patent No. 1,422,869, and Japanese Patent O.P.I. Publication Nos. 24937/1981 and 45016/1980 may also be used. Adding amount of such the sulfur sensitizer varies in a fairly wide range according to various conditions such as the pH, temperature, silver halide grain size and the like, but, as a standard, is preferably from $10^{-7}$ mole to $10^{-1}$ mole per mole of silver halide.

As the selenium sensitizer, aliphatic isoselenocyanates such as allylisoselenocyanates; selenothiourea; selenoketones; selenoamides; selenocarboxylic acid salts and esters; selenophosphates; and selenides such as diethyl selenide, diethyl diselenide, etc., may be used. Particular examples of these sensitizers are described in U.S. Pat. Nos. 1,574,944, 1,602,592 and 1,623,499.

Further, a reduction sensitizer may be combinedly used. Examples of the reduction sensitizer include stannous chloride, thiourea dioxide, hydrazine, polyamine, and the like.

Further, non-gold noble metal compounds such as palladium compounds may also be used in combination.

The silver halide grain of this invention is desirable to contain a gold compound. The gold compound suitably usable in this invention may be either one having an oxidation number of +1 or one having an oxidation number of +3, and thus various gold compounds are allowed to be used, typical examples of which include chloroaurates such as potassium chloroaurate; auric trichloride, potassium auric thiocyanate, potassium iodoaurate, tetracyano auric acid, ammonium aurothiocyanate, pyridyltrichloro gold, gold sulfide, gold selenide, and the like.

Any of such gold compounds may be used either so as to sensitize the silver halide grain or in such a way as substantially not to contribute to the sensitization.

The adding amount of these gold compounds differs according to various conditions, but, as a standard, is from $10^{-8}$ mole to $10^{-1}$ mole per mole of silver halide, and preferably from $10^{-7}$ mole to $10^{-2}$ mole.

The addition of these compounds may be made at any point of time during the formation of silver halide grains, during the course of physical ripening, during the chemical ripening or after completion of the chemical ripening.

The silver halide grains to be used in the emulsion layer other than the silver halide emulsion layer of this invention, although not particularly restricted, are preferably ones containing the same silver halide grains whose silver chloride content is not less than 90 mole % as used in the silver halide emulsion layer of this invention.

The emulsion of this invention may be spectrally sensitized to any desired wavelength regions by using those dyes known as sensitizing dyes to those skilled in the art. Such sensitizing dyes may be used alone or in combination of two of more thereof. Any of those supersensitizers which are dyes which in themselves have no spectral sensitization effect or compounds which do substantially not absorb visible rays but strengthen the sensitization effect of these sensitizing dyes may also be incorporated along with these sensitizing dyes into the emulsion.

Where the silver halide emulsion of this invention is to be used as a blue-sensitive emulsion, the emulsion is desirable to be spectrally sensitized by a sensitizing dye having the following Formula A:

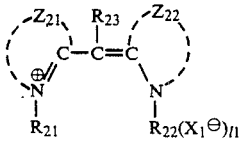

Formula A wherein $Z_{21}$ and $Z_{22}$ each is a group of atoms necessary to form a benzoxazole nucleus, naphthoxazole nucleus, benzoselenazole nucleus, naphthoselenazole nucleus, benzothiazole nucleus, naphthothiazole nucleus, benzimidazole nucleus, naphthoimidazole nucleus, pyridine nucleus, or quinoline nucleus, provided that these heterocyclic nucleus include those each having a substituent.

The substituent to the heterocyclic nucleus formed by the $Z_{21}$ or $Z_{22}$ includes a halogen atom, cyano group, methyl group, ethyl group, methoxy group or ethoxy group.

$R_{21}$ and $R_{22}$ each is an alkyl group, alkenyl group or aryl group, but preferably an alkyl group, more preferably a carboxyl or sulfo group-substituted alkyl group, and most preferably a sulfoalkyl group having from 1 to 4 carbon atoms. $R_{23}$ is one selected from the class consisting of a hydrogen atom, methyl group and ethyl group. $X_1^{\ominus}$ represents an anion. And $l_1$ is an integer of 0 or 1.

The most useful dyes among those sensitizing dyes having Formula A are those sensitizing dyes having the following Formula A':

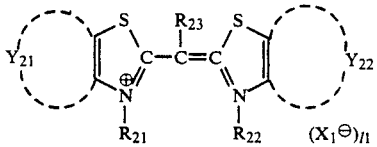

Formula A' wherein $Y_{21}$ and $Y_{22}$ each is a group of atoms necessary to form a benzene ring or naphthalene ring, both being substitutable. The benzene ring and naphthalene ring formed by the $Y_{21}$ and $Y_{22}$ include those each having a substituent, and the substituent is preferably a halogen atom, cyano group, methyl group, ethyl group, methoxy group or ethoxy group.

The above $R_{21}$, $R_{22}$, $R_{23}$, $X_1^{\ominus}$ and $l_1$ are as defined in the foregoing Formula A.

Where the silver halide emulsion is to be used as a green-sensitive emulsion, the emulsion is desirable to be spectrally sensitized by using a sensitizing dye having the following Formula B:

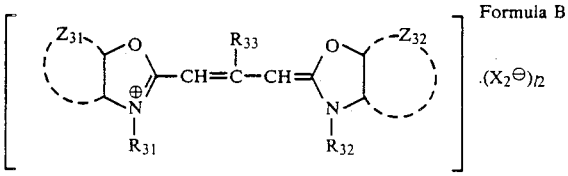

Formula B wherein $Z_{31}$ and $Z_{32}$ each is a group of atoms necessary to form a benzen ring or a naphthalene ring which each is condensed with an oxazole. The formed heterocyclic nucleus is allowed to be substituted by one of various substituents. The substituent is preferably a halogen atom, aryl group, alkyl group or alkoxy group, more preferably a halogen atom, phenyl group or methoxy group, and most preferably a phenyl group.

According to a preferred embodiment of this invention, the $Z_{31}$ and $Z_{32}$ represent benzene rings condensed with oxazole rings, and at least one of these benzene rings is substituted at its fifth position by a phenyl group, or one benzene ring is substituted at its fifth position by a phenyl group and the other is substituted at its fifth position by a halogen atom.

$R_{31}$ and $R_{32}$ each is an alkyl group, alkenyl group or aryl group, preferably an alkyl group, more preferably an alkyl group substituted by a carboxyl or sulfo group, and still more preferably a sulfoalkyl group having from 1 to 4 carbon atoms, and most preferably a sulfoethyl group.

$R_{33}$ is a hydrogen atom or alkyl group having from 1 to 3 carbon atoms, and preferably a hydrogen atom or ethyl group.

$X_2^{\ominus}$ is an anion, e.g., a halogen ion such as, of chlorine, bromine or iodine, or another anion such as of

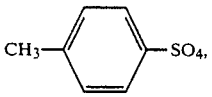

$CH_3SO_4$, $C_2H_5SO_4$ or the like, and $l_2$ is an integer of 1 or 0, provided that the $l_2$ is 0 when the compound forms a intramolecular salt.

Where the silver halide emulsion of this invention is used as a red-sensitive emulsion, the emulsion is desirable to be spectrally sensitized by using a sensitizing dye having the following formula C or a sensitizing dye having the following Formula D:

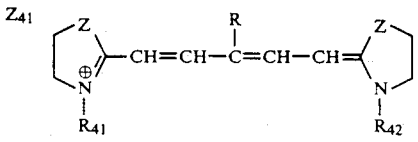

Formula C

-continued

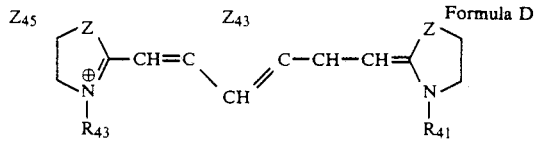

Formula D wherein R is a hydrogen atom or alkyl group; $R_{41}$ through $R_{44}$ each is an alkyl group or aryl group; $Z_{41}$, $Z_{42}$, $Z_{44}$ and $Z_{45}$ each is a group of atoms necessary to form a benzene ring or naphthalene ring which each is condensed with a thiazole ring or selenazole ring; $Z_{43}$ is a group of hydrocarbon atoms necessary to form a 6-member ring; $l_3$ is an integer of 1 or 2; Z is a sulfur atom or selenium atom; and $X_3^{\ominus}$ is an anion.

In the above formulas, the alkyl group represented by the R is a methyl, ethyl or propyl group. The R is preferably a hydrogen atom, methyl or ethyl group, and more preferably a hydrogen atom or ethyl group.

The $R_{41}$, $R_{42}$, $R_{43}$ and $R_{44}$ each is a group selected from the class consisting of a substitutable straight-chain or branched-chain alkyl group (such as, e.g., methyl, ethyl, propyl, chloroethyl, hydroxyethyl, methoxyethyl, acetoxyethyl, carboxymethyl, carboxyethyl, ethoxycarbonylmethyl, sulfoethyl, sulfopropyl, sulfobutyl, $\beta$-hydroxy-$\gamma$-sulfopropyl, sulfate propyl, allyl, benzyl or the like) and a substitutable aryl group (such as phenyl, carboxyphenyl, sulfophenyl or the like).

The heterocyclic ring formed by the $Z_{41}$, $Z_{42}$, $Z_{44}$ or $Z_{45}$ is allowed to have a substituent. The substituent is preferably a halogen atom, aryl, alkyl or alkoxy group, and more preferably a halogen atom (such as chlorine), phenyl or methoxy group.

The $X_3^{\ominus}$ is an anion such as of Cl, Br, I,

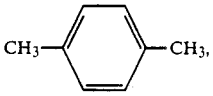

$CH_3SO_4$, $C_2H_5SO_4$ or the like; and $l_3$ is an integer of 1 or 2, provided that the $l_3$ is 1 when the compound forms an intramolecular salt.

The adding amount of any of those sensitizing dyes having Formula A, B, C or D, although not particularly restricted, is within the range of preferably from about $1\times10^{-7}$ to about $1\times10^{-3}$ mole per mole of silver halide, and more preferably from $5\times10^{-6}$ to $5\times10^{-4}$ mole.

Also, in the light-sensitive silver halide photographic material of this invention, at least one layer of its photographic constituent layer including the light-sensitive layers comprising the silver halide emulsion layer containing the foregoing silver halide grains of this invention and other silver halide emulsion layer and the non-light-sensitive layers such as an intermediate layer, protective layer, filter layer, antihalation layer and the like, contains at least one first compound selected from the organic compounds capable of forming a compound having a solubility product (Ksp) of not more than $1\times10^{-11}$ with a silver ion and at least one second compound selected from the compounds having Formulas I, II, III and IV.

The organic compound whose solubility product (Ksp) with silver ions is not more than $1\times10^{-11}$ will now be explained below:

For measurement and calculation of the above-mentioned solubility product (Ksp) with silver ions, reference can be made to the 'Shin-Jikken Kagaku Koza' ('New Experimental Chemistry Course') Vol. 1, pp.233–250.

The organic compound having the foregoing solubility product with silver ions of not more than $1\times10^{-11}$ (hereinafter referred to as the organic compound of this invention) is preferably a mercapto compound having the following Formula S.

Formula S

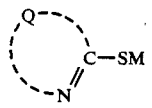

wherein Q is a group of atoms necessary to form a 5- or 6-member heterocyclic ring or a 5- or 6-member heterocyclic ring condensed with a benzene or naphthalene ring; and M is a hydrogen atom or a cation.

Those mercapto compounds having Formula S which are suitably usable as the organic compound of this invention will then be explained:

In Formula S, the Q is a group of atoms necessary to form a 5- or 6-member heterocyclic ring or a 5- or 6-member heterocyclic ring condensed with a benzene or naphthalene ring, wherein the heterocyclic ring to be formed by the Q is, for example, an imidazole ring, tetrazole ring, thiazole ring, oxazole ring, selenazole ring, benzimidazole ring, naphthoimidazole ring, benzothiazole ring, naphthothiazole ring, benzoselenazole ring, naphthoselenazole ring, benzoxazole ring, or the like.

The cation represented by the M is of, for example, an alkali metal (such as sodium, potassium), ammonium group, or the like.

The mercapto compounds having Formula S include those preferred mercapto compounds having Formulas SA, SB, SC and SD.

Formula SA

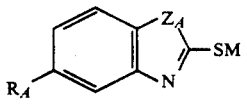

wherein $R_A$ is a hydrogen atom, alkyl group, alkoxy group, aryl group, halogen atom, carboxyl group or a salt thereof, sulfo group or a salt thereof, or amino group; $Z_A$ is —NH—, —O— or —S—; and M is the same as the M defined in Formula S.

Formula SB

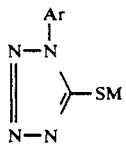

wherein Ar represents

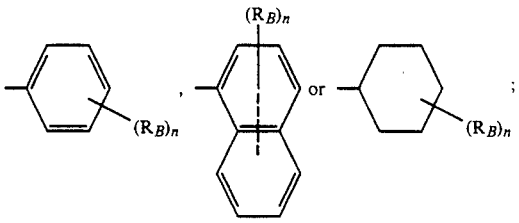

$R_B$ is an alkyl group, alkoxy group, carboxyl group or a salt thereof, sulfo group or a salt thereof, hydroxyl group, amino group, acylamino group, carbamoyl group or sulfonamido group; n is an integer of from 0 to 2; and M is the same as the M defined in Formula S.

In Formulas SA and SB, the alkyl group represented by the $R_A$ or $R_B$ is, for example, a methyl group, ethyl group, butyl group or the like; the alkoxy group is, for example, a methoxy group, ethoxy group or the like; and the salt of the carboxyl and sulfo groups is, for example, a sodium salt, ammonium salt, or the like.

In Formula SA, the aryl group represented by the $R_A$ is, for example, a phenyl group, naphthyl group or the like; and the halogen atom is, for example, a chlorine atom, bromine atom or the like.

In Formula SB, the acylamino group represented by the $R_B$ is, for example, a methylcarbonylamino group, benzoylamino group or the like; the carbamoyl group is, for example, an ethylcarbamoyl group, phenylcarbamoyl group, or the like; and the sulfonamido group is, for example, a methylsulfonamido group, phenylsulfonamido group, or the like.

The above-mentioned alkyl, alkoxy, aryl, amino, acylamino, carbamoyl and sulfonamido groups further include those each having a substituent.

Formula SC

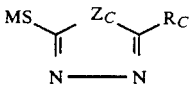

wherein $Z_C$ is

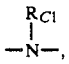

an oxygen atom or sulfur atom; $R_C$ is a hydrogen atom, alkyl group, aryl group, alkenyl group, cycloalkyl group, $—SR_{C1}$,

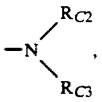

$—NHCOR_{C4}$, $—NHSO_2R_{C5}$ or heterocyclic group, wherein $R_{C1}$ is a hydrogen atom, alkyl group, alkenyl group, cycloalkyl group, aryl group, $—COR_{C4}$, or $—SO_2R_{C5}$, $R_{C2}$ and $R_{C3}$ each is a hydrogen atom, alkyl group or aryl group, and $R_{C4}$ and $R_{C5}$ each is an alkyl group or aryl group; and M is the same as the M defined in Formula S.

The alkyl group represented by the $R_C$, $R_{C1}$, $R_{C2}$, $R_{C3}$, $R_{C4}$ and $R_{C5}$ of Formula SC is, e.g., a methyl group, benzyl group, ethyl group, propyl group or the like; the aryl group is, e.g., a phenyl group, naphthyl group or the like.

The alkenyl group represented by the $R_C$ or $R_{C1}$ is, e.g., propenyl group or the like; the cycloalkyl group is, e.g., a cyclohexyl group or the like. And the heterocyclic group represented by the $R_C$ is, e.g., a furyl group, pyridinyl group or the like.

The alkyl and aryl groups represented by the above $R_C$, $R_{C1}$, $R_{C2}$, $R_{C3}$, $R_{C4}$ or $R_{C5}$, the alkenyl and cycloalkyl groups represented by the $R_C$ or $R_{C1}$, and the heterocyclic groups represented by the $R_C$ further include those each having a substituent.

Formula SD

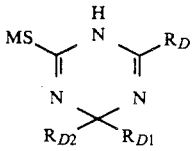

wherein and $R_D$ and M are the same as the $R_C$ and the M, respectively, defined in Formula SC. Also, $R_{D1}$ and $R_{D2}$ are the same as the $R_{C1}$ and $R_{C2}$, respectively, defined in Formula SC.

The following are examples of the compounds having Formula S, but this invention is not limited to and by the examples.

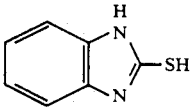

SA-1

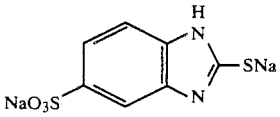

SA-2

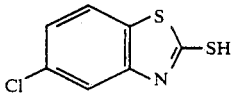

SA-3

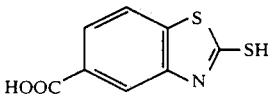

SA-4

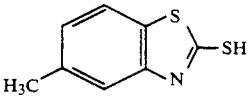

SA-5

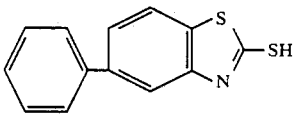

SA-6

-continued

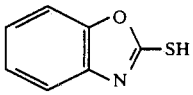

SA-7

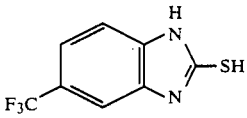

SA-8

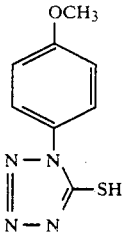

SB-1

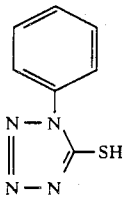

SB-2

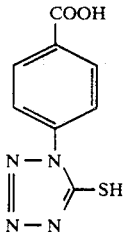

SB-3

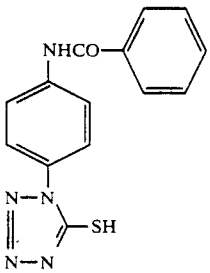

SB-4

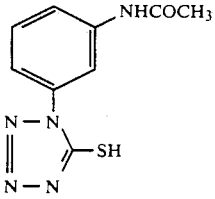

SB-5

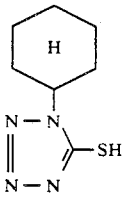

SB-6

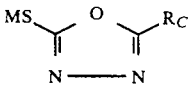

| Exemplified compound | $R_C$ | M |
|---|---|---|
| SC-1 | $-C_2H_5$ | —H |
| SC-2 | $-CH_2-CH=CH_2$ | —H |
| SC-3 | $-CH=CH-CH_2-CH_3$ | —H |
| SC-4 | $-C_7H_{15}$ | —H |
| SC-5 | $-C_9H_{19}$ | —Na |
| SC-6 | 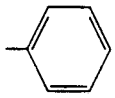 | —H |
| SC-7 | $-C_4H_9(t)$ | —H |

-continued
| | | |
|---|---|---|
| SC-8 | 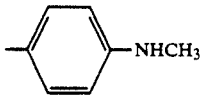 | —H |
| SC-9 | 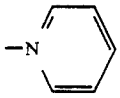 | —H |
| SC-10 | 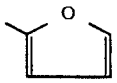 | —H |
| SC-11 | 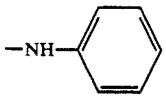 | —H |
| SC-12 | 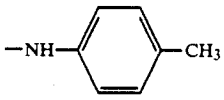 | —$NH_4$ |
| SC-13 | —$NHCOCH_3$ | —H |
| SC-14 | 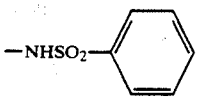 | —H |
| SC-15 | —$N(CH_3)_2$ | —H |
| SC-16 | 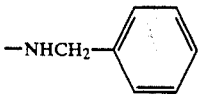 | —H |
| SC-17 | 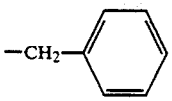 | —H |
| SC-18 | —S—$CH_3$ | —H |
| SC-19 | 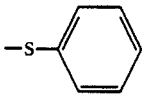 | —H |
| SC-20 | —SH | —H |
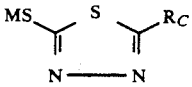
| Exemplified compound | $R_C$ | M |
|---|---|---|
| SC-21 | —H | —H |
| SC-22 | —$C_2H_5$ | —H |
| SC-23 | —$C_4H_9$(t) | —H |
| SC-24 | —$C_6H_{13}$ | —H |
| SC-25 | 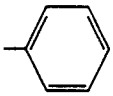 | —H |

-continued
| | | |
|---|---|---|
| SC-26 | 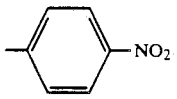 | —H |
| SC-27 | 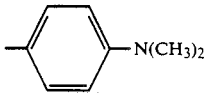 | —H |
| SC-28 | 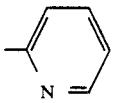 | —H |
| SC-29 | 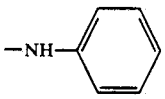 | —H |
| SC-30 | $-NH_2$ | —H |
| SC-31 | $-CH_2CH{=}CH_2$ | —H |
| SC-32 | —SH | —H |
| SC-33 | $-NHCOC_2H_5$ | —H |
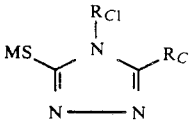
| Exemplified compound | $R_C$ | $R_{C1}$ | M |
|---|---|---|---|
| SC-34 | $-C_2H_5$ | —H | —H |
| SC-35 | $-CH_3$ | $-CH_3$ | —H |
| SC-36 | $-CH_3$ | 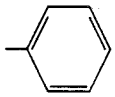 | —H |
| SC-37 | $-NHCOCH_3$ | $-CH_3$ | —H |
| SC-38 | 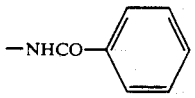 | 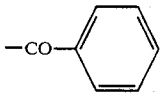 | —H |
| SC-39 | $-NHCOCH_3$ | $-COCH_3$ | —H |
| SC-40 | $-NHCOCH_3$ | 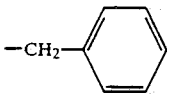 | —H |
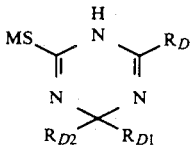
| Exemplified compound | $R_D$ | $R_{D1}$ | $R_{D2}$ | M |
|---|---|---|---|---|
| SD-1 | $-C_2H_5$ | $-CH_3$ | $-CH_3$ | —H |
| SD-2 | 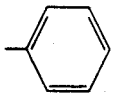 | $-CH_3$ | $-CH_3$ | —H |

-continued

| | | | | |
|---|---|---|---|---|
| SD-3 | $-NH_2$ | $-H$ | 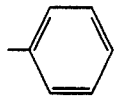 | $-H$ |
| SD-4 | 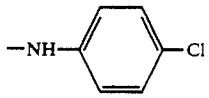 | $-H$ | $-C_4H_9$ | $-H$ |
| SD-5 | $-NHCOCH_3$ | $-CH_3$ | $-CH_3$ | $-H$ |
| SD-6 | 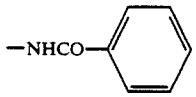 | $-CH_3$ | $-CH_3$ | $-H$ |
| SD-7 | 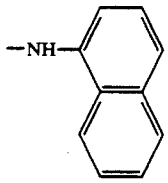 | $-CH_3$ | $-C_3H_7(i)$ | $-H$ |
| SD-8 | 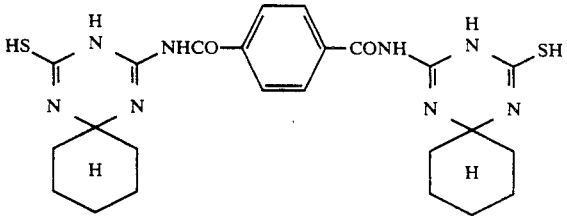 | | | |

These compounds having Formula S include those compounds as described in, e.g., Japanese Patent Examined Publication No. 28496/1965, Japanese Patent O.P.I. Publication No. 89034/1975, J. Chem. Soc. 49, 1748 (1927) and 4237 (1952), J. Org. Chem. 39, 2469 (1965), U.S. Pat. No. 2,824,001, J. Chem. Soc. 1723 (1951), Japanese Patent O.P.I. Publication No. 111846/1981, British Patent No. 1,275,701, U.S. Pat. Nos. 3,266,897, 2,403,927, and the like, and these compounds may be synthesized according to those methods as described also in these publications.

Incorporation of the compound having Formula S according to this invention (hereinafter referred to as Compound S) into the photographic constituent layer of this invention may be carried out in the manner that the compound is dissolved into water or an organic solvent miscible arbitrarily with water (such as methanol, ethanol, etc.), and the solution is then added to the constituent layer. Compounds S may be used alone or in combination of two or more thereof or in combination with stabilizers or antifoggants other than Compounds S.

The addition of Compound S may be made at any point of time during the period up to the completion of coating liquid preparation.

Compound S may be added to any photographic constituent layer, and preferably to the silver halide emulsion layer.

To the photographic constituent layer may be added the whole of Compound S at a time, but preferably in several installments.

The adding amount of Compound S, although not restricted, is in the range of normally from $1\times10^{-6}$ mole to $1\times10^{-1}$ mole per mole of silver halide, and preferably from $1\times10^{-5}$ mole to $1\times10^{-2}$ mole.

In this invention, at least one of the photographic constituent layers contains at least one second compound selected from the compounds having Formulas I through IV.

In Formulas I through IV, the $R_1$ is a hydrogen atom, alkyl group or aryl group; the $R_2$ is a hydrogen atom, halogen atom, alkyl group, aryl group, nitro group, carboxy group, sulfo group, sulfamoyl group, hydroxy group, alkoxy group or thiazolyl group; the $Z_1$ is a group of non-metal atoms necessary to form a thiazoline ring; the $R_3$ and $R_4$ each is an alkyl group, aryl group, —COR or

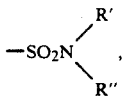

wherein R′ and R″ each is an alkyl or aryl group, provided that the $R_3$ and $R_4$ are allowed to form a ring together with the nitrogen atom; the $R_5$, $R_6$ and $R_7$ each is a halogen atom or alkyl group; the $R_8$ and $R_9$ each is a hydrogen atom, alkyl group, aryl group or nitrogen-containing heterocyclic ring; the $R_{10}$ is a hydrogen atom, alkyl group, cycloalkyl group, alkenyl group, aryl group, heterocyclic group, alkylaminocarbonyl group, arylaminocarbonyl group, alkylaminosulfonyl group or arylaminosulfonyl group; the $R_{11}$ and $R_{12}$ each is a hydrogen atom, halogen atom, alkyl group, cycloalkyl group, aryl group, cyano group, alkylthio group, arylthio group, alkylsulfonyl group, alkylsulfonyloxy group or heterocyclic group, provided that the $R_{11}$ and $R_{12}$ are allowed to form a ring together.

These substitutable groups represented by the above $R_1$ through $R_{12}$ may have further substituents.

These compounds having Formulas I through IV are known compounds and include those compounds as described in Japanese Patent O.P.I. Publication Nos. 27424/1979, 157244/1982, 84237/1984, 226344/1984, 263938/1985, 233743/1986, and the like.

The following are examples representative of the compounds having Formulas I through IV, but the invention is not limited to and by the examples.

Exemplified Compounds

I-1

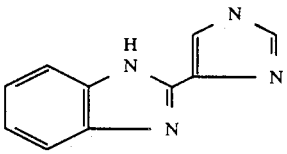

I-2

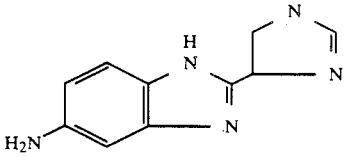

I-3

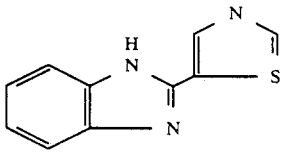

I-4

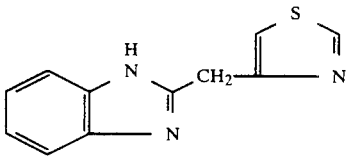

I-5

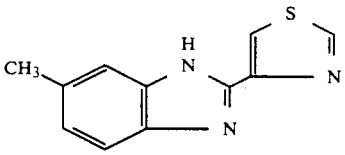

I-6

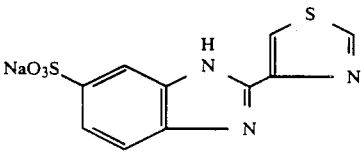

I-7

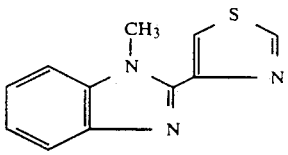

-continued

Exemplified Compounds

I-8

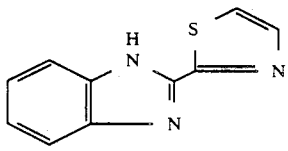

I-9

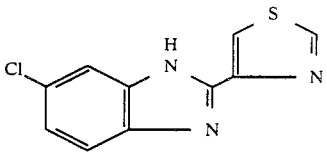

I-10

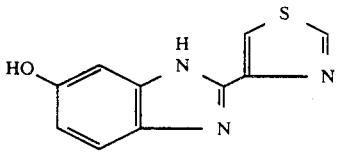

II-1

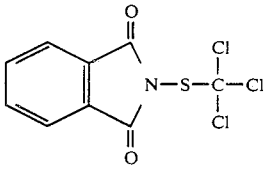

II-2

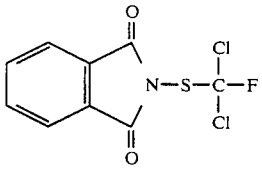

II-3

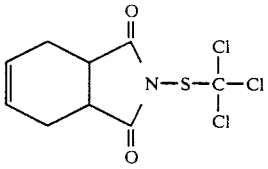

II-4

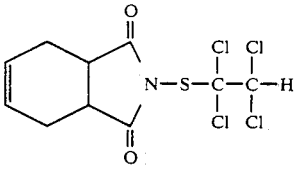

II-5

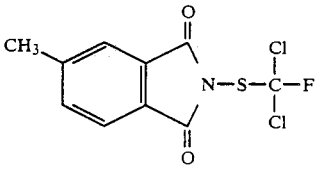

II-6

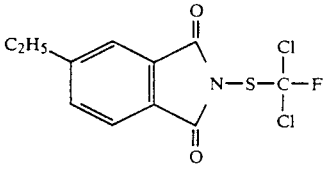

-continued
Exemplified Compounds
II-7
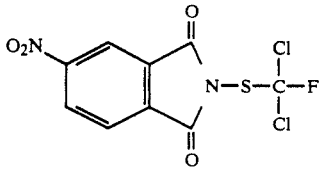
II-8
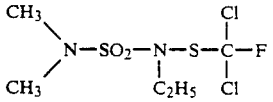
II-9
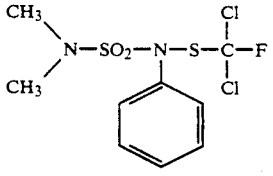
II-10
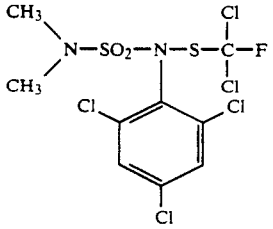
II-11
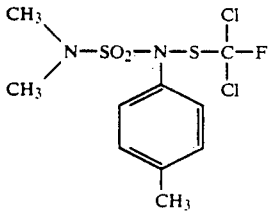
II-12
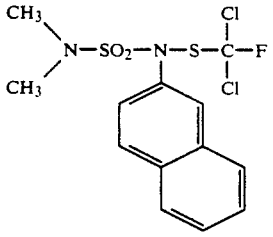
II-13
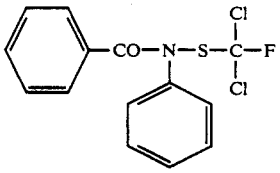
III-1
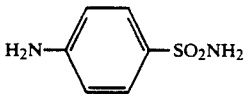
III-2
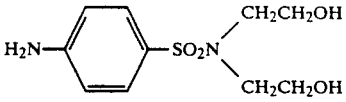
-continued
Exemplified Compounds
III-3
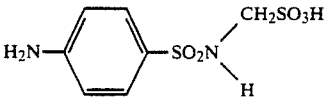
III-4
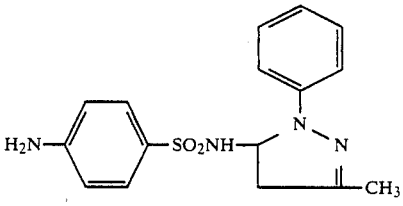
III-5
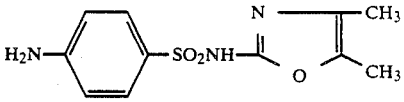
III-6
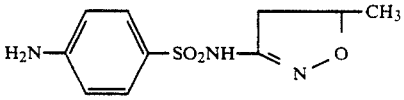
III-7
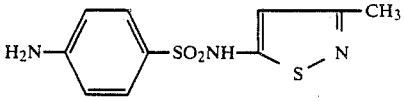
III-8
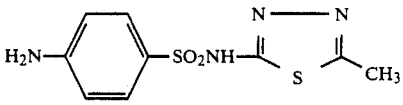
III-9
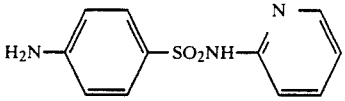
III-10
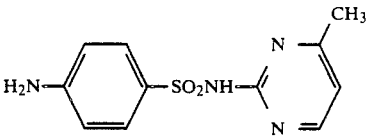
IV-1
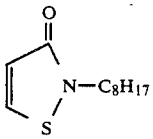
IV-2
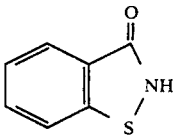
IV-3
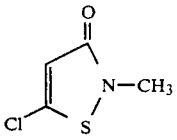

-continued

Exemplified Compounds

IV-4

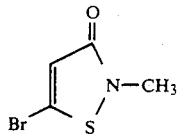

IV-5

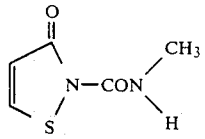

IV-6

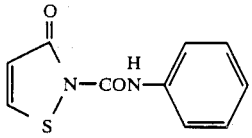

IV-7

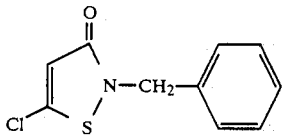

IV-8

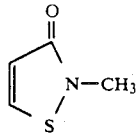

These compounds having Formulas I through IV may be added to any photographic constituent layer, but preferably to the non-light-sensitive layers when taking into account photographic characteristics. Any of the above compounds should be added at the time of preparing the colloid solution or emulsion for the photographic constituent layers, whereby possible rottenness or decomposition of the emulsion can be prevented.

The preferred among these compounds having Formulas I through IV are the compounds having Formulas I, II and IV, and more preferred are the compounds having Formulas I and IV.

The adding amount of the compound to the photographic constituent layers is preferably from $5\times10-7$ to $2\times10-3$ mole/m$^2$, and more preferably from $5\times10-6$ to $5\times10-4$ mole/m$^2$. When incorporating the compound into the light-sensitive material of this invention, it is desirable that the compound be dissolved into a solvent such as water, methanol, ethanol, ethylene glycol, diethylene glycol, triethylene glycol, benzyl alcohol, ethanolamine, diethanolamine, trimethanolamine or the like to prepare a solution or an emulsified liquid thereof, which is then added to the photographic constituent layers.

The light-sensitive silver halide photographic material of this invention having the above construction can be, for example, a color positive or negative film or a color photographic paper, but the effect of this invention can be well exhibited particularly when it is applied to color photographic paper, which is provided directly for appreciation.

The light-sensitive silver halide photographic material of this invention to be used principally as photographic paper may be for either monochromatic or multi-color use. Where it is a silver halide photographic material for multi-color use, the light-sensitive material, for subtractive color reproduction, normally has a construction comprising a support having thereon an arbitrary number of silver halide emulsion layers separately containing photographic magenta coupler, yellow coupler and cyan coupler and non-light-sensitive layers, which are coated in an arbitrary order, but the number of and the coating order of such layers may be discretionary changed according to the priority characteristic or the purpose for which the light-sensitive material is used.

Where the light-sensitive silver halide photographic material of this invention is a multi-color light-sensitive material, its concrete construction is particularly desirable to be such that on its support be arranged a yellow dye image-forming layer, an intermediate layer, a magenta dye image-forming layer, an intermediate layer, a cyan dye image-forming layer, an intermediate layer and a protective layer in the described order from the support side.

Thus, dye forming couplers are used in the light-sensitive silver halide photographic material of this invention. These dye forming couplers are desirable to have in the molecule thereof a group called 'ballasting group' having not less than 8 carbon atoms for making the coupler nondiffusible.

As the yellow dye-forming coupler, acylacetanilide-type couplers may be suitably used. Out of these couplers, benzoylacetanilide-type and pivaloylacetanilide-type compounds are advantageous, which are preferably those compounds having the following Formula Y:

Formula Y

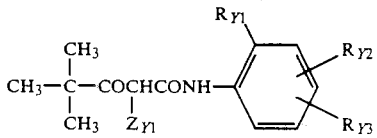

wherein $R_{Y1}$ is a halogen atom or alkoxy group; $R_{Y2}$ is a hydrogen atom, halogen atom or alkoxy group; $R_{Y3}$ is an acylamino group, alkoxycarbonyl group, alkylsulfamoyl group, arylsulfamoyl group, arylsulfonamido group, alkylureido group, arylureido group, succinimido group, alkoxy group or aryloxy group; and $Z_{Y1}$ is a group capable of being split off upon the reaction with the oxidation product of a color developing agent.

Examples of the yellow coupler usable in this invention are those as described in British Patent No. 1,077,874, Japanese Patent Examined Publication No. 40757/1970, Japanese Patent O.P.I. Publication Nos. 1031/1972, 26133/1972, 94432/1973, 87650/1975, 3631/1976, 115219/1977, 99433/1979, 133329/1979 and 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155 and 4,401,752.

As the magenta dye-forming coupler, 5-pyrazolone-type couplers, pyrazoloazole-type couplers and the like may be suitably used, which are preferably those couplers having the following Formulas P and M.

Formula P

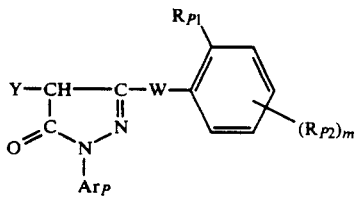

wherein $Ar_p$ is an aryl group; $Rp_1$ is a hydrogen atom or a substituent; $Rp_2$ is a substituent; Y is a hydrogen atom or a group capable of being split off upon the reaction with the oxidation product of a color developing agent; W is —NH—, —NHCO— (wherein the N atom is bonded to the carbon atom of the pyrazolone nucleus) or —NHCONH—; and m is an integer of 1 or 2.

Formula M

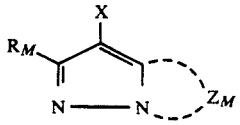

wherein $Z_M$ is a group of non-metal atoms necessary to form a nitrogen-containing heterocyclic ring, and the ring to be formed by the $Z_M$ may have a subtuent; X is a group capable of being split off upon the reaction with the oxidation product of a color developing agent; $R_M$ is a hydrogen atom or a substituent.

The substituent represented by the $R_M$ is, for example, a halogen atom, alkyl group, cycloalkyl group, alkenyl group, cycloalkenyl group, alkinyl group, aryl group, heterocyclic group, acyl group, sulfonyl group, sulfinyl group, phosphonyl group, carbamoyl group, sulfamoyl group, cyano group, spiro compound residue, bridged hydrocarbon compound residue, alkoxy group, aryloxy group, heterocyclic oxy group, siloxy group, acyloxy group, carbamoyloxy group, amino group, acylamino group, sulfonamido group, imido group, ureido group, sulfamoylamino group, alkoxycarbonylaminog group, aryloxycarbonylamino group, alkoxycarbonyl group, aryloxycarbonyl group, alkylthio group, arylthio group or heterocyclic thio group.

These are described in, e.g., U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,928,044, 3,930,861, 3,930,866 and 3,933,500, Japanese Patent O.P.I. Publication Nos. 29639/1974, 111631/1974, 129538/1974, 13041/1975, 58922/1977, 62454/1980, 118034/1980, 38043/1981, 35858/1982 and 23855/1985, British Patent No. 1,247,493, Belgian Patent Nos. 769,116 and 792,525, West German Patent No. 2,156,111, Japanese Patent Examined Publication No. 60479/1971, Japanese Patent O.P.I. Publication Nos. 125732/1984, 228252/1984, 162548/1984, 171956/1984, 333552/1985 and 43659/1985, West German Patent No. 1,070,030, and U.S. Pat. No.3,725,067.

As the cyan dye-forming coupler, phenol-type and naphthol-type cyan couplers may be used, of which those couplers having the following Formulas E and F are preferably used.

Formula E

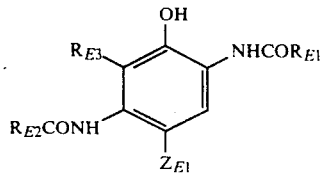

wherein $R_{E1}$ is an aryl group, cycloalkyl group or a heterocyclic group; $R_{E2}$ is an alkyl group or phenyl group; $R_{E3}$ is a hydrogen atom, halogen atom, alkyl group or alkoxy group; $Z_{E1}$ is a hydrogen atom or a group capable of being split off upon the reaction with the oxidation product of a color developing agent.

Formula F

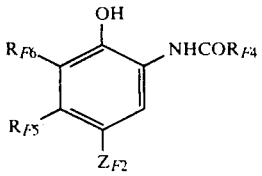

wherein $R_{F4}$ is an alkyl group such as methyl, ethyl, propyl, butyl, nonyl; $R_{F5}$ is an alkyl group such as methyl, ethyl; $R_{F6}$ is a hydrogen atom, halogen atom such as fluorine, chlorine, bromine or alkyl group such as methyl, ethyl; and $Z_{F2}$ is a hydrogen atom or a group capable of being split off upon the reaction with the oxidation product of a color developing agent.

These cyan dye image-forming couplers are described in U.S. Pat. Nos. 2,306,410, 2,356,475, 2,362,598, 2,367,531, 2,369,929, 2,432,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044, British Patent Nos. 478,991, 945,542, 1,084,480, 1,377,233, 1,388,024 and 1,543,040, and Japanese Patent O.P.I. Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, 32071/1980, 146050/1984, 31953/1984 and 117249/1985.

The dye-forming coupler to be applied to this invention may be used in each silver halide emulsion layer in the range of normally from $1\times10-3$ mole to 1 mole per mole of silver halide, and preferably from $1\times10-2$ mole to $8\times10-1$ mole per mole of silver halide.

As the binder (or protective colloid) to be used in the light-sensitive silver halide photographic material of this invention, gelatin is advantageously used, and in addition, gelatin derivatives, graft polymers obtained from gelatin and other high molecular materials, protein, sugar derivatives, cellulose derivatives, and hydrophilic colloids including synthetic hydrophilic high-molecular materials such as homo-or copolymers may also be used.

In the light-sensitive silver halide photographic material of this invention, additives such as a hardening agent, anti-color-stain agent, image stabilizer, ultraviolet absorbing agent, plasticizer, latex, surface active agent, matting agent, lubricant, antistatic agent, and the like, may be arbitrarily used.

The light-sensitive silver halide photographic material of this invention is capable of forming an image by being processed according to a color developing procedure known to those skilled in the art.

The light-sensitive silver halide photographic material of this invention is imagewise exposed and then developed in a color developer solution containing a color developing agent. Useful examples of the color developing agent include N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-β-methansulfonamidoethyl-3-methyl-4-aminoaniline sulfate, N-ethyl-N-β-hydroxylethylaminoaniline sulfate, 4-amino-3-methyl-N,N-diethylaniline hydrochloride, N-ethyl-N-β-hydroxylethyl-3-methyl-4-aminoaniline sulfate, 4-amino-N-(β-methoxyethyl)-N-ethyl-3-methylaniline-p-toluene sulfonate, and the like.

These color developing agents may be used alone or in combination of two or more thereof. The color developing agent concentration of a color developer solution may be appropriately selected within the range of from 0.01 mole to 0.05 mole per liter of a color developer solution.

The color developer solution is desirable to contain a hydroxylamine-type compound as a preservative. Any hydroxylamine-type compounds may be used with no restriction, which include, e.g., hydroxylamine; N-monoalkylhydroxylamines such as N-methylhydroxylamine hydrochloride; N,N-dialkylhydroxylamines such as N,N-diethylhydroxylamine, those aminoalkylhydroxylamines as described in U.S. Pat. No. 3,287,125, those alkoxyhydroxylamines as described in U.S. Pat. No. 3,293,034, those sulfonhydroxylamines as described in U.S. Pat. No. 3,287,124; and heterocyclic N-hydroxylamines such as N-hydroxypiperidine. These may be used as they are or in the salt form. However, from the standpoint of cost, stability, water-solubility, availability or aptitude for use, hydroxylamine sulfate, hydroxylamine hydrochloride, N,N-diethylhydroxylamine, N,N-diethylhydroxylamine oxalate or the like is preferred. The concentration of the hydroxylamine-type compound to be used, although it depends upon the pH or temperature of a color developer solution, is preferred to be in the range of from 0.01 mole to 0.2 mole per liter of a color developer solution, and more preferably from 0.010 mole to 0.10 mole.

Further, the color developer solution is desirable to contain a sulfite such as sodium sulfite or potassium sulfite in an amount of preferably not more than $2\times10-2$ mole/liter, more preferably $1\times10-2$ mole/liter, and most preferably from $5\times10-3$ to $1\times10-2$ mole/liter.

To the color developer solution is further added an ordinary alkali agent appropriately selected from the class consisting of sodium hydroxide, potassium hydroxide, ammonium hydroxide, sodium carbonate, potassium carbonate, sodium sulfate, sodium metaborate, sodium tertiary phosphate and potassium tertiary phosphate. Also, in order to provide an alkali-buffering capability to the solution, disodium hydrogenphosphate, dipotassium hydrogenphosphate, sodium dihydrogenphosphate, potassium dihydrogenphosphate, potassium hydrogencarbonate, sodium hydrogen carbonate, or other salts may be used.

Into the color developer solution may be arbitrarily incorporated various other additives such as, e.g., benzyl alcohol, halogenated alkalies such as potassium bromide, calcium chloride, etc., development control agents such as citrazic acid, defoaming agent, surface active agent, and organic solvent such as methanol, dimethylformamide, dimethylsulfoxide, etc.

However, the benzyl alcohol is not always necessary for the color developer solution of this invention, and is desirable not to be used from an environmental pollution point of view. The bromide ion concentration, in potassium bromide equivalent, should be 0.4 to 2.0 g per liter of the color developer solution, and preferably from 0.6 to 1.5 g.

The pH value of the color developer solution is normally not less than 7, and most generally from about 10 to about 13.

The color developer solution temperature is normally not less than 15° C., and generally in the range of from 20° C. to 50° C. For rapid processing, the developer solution is desirable to be used at not less than 30° C. The conventional developing time is from 3 to 4 minutes, but the color developing time according to this invention, which is intended for rapid processing, is in general in the range of preferably from 20 to 60 seconds, and more preferably from 30 to 50 seconds.

The light-sensitive material to be used in this invention is color-developed to form a dye image, and after that both the undeveloped silver halide and the developed silver must be removed by a bleach-fix bath.

The bleach-fix bath basically contains both bleaching agent and fixing agent.

The bleach-fix process in this invention is a process to oxidize the metal silver that has been produced by development into a silver halide and then to form a water-soluble complex as well as to color-form the un-color-developed portion of the color developing agent.

As the bleaching agent to be used in the bleach-fix bath, an organic acid's metal complex salt is preferred, in which a metal ion such as iron, cobalt or copper is coordinated in an organic acid such as aminocarboxylic acid, oxalic acid or citric acid. The most preferred organic acids for use in forming such organic acid's metal complex salts are polycarboxylic acids. These polycarboxylic acids or aminopolycarboxylic acids are allowed to be in the form of alkali metal salts, ammonium salts or water-soluble amine salts.

The bleaching agent is used in an amount of from 5 to 450 g/liter, and more preferably from 20 to 250 g/liter.

The bleach-fix bath, in addition to the above bleaching agent, contains a silver halide fixing agent and, if necessary, an sulfite as a preservative.

Also, as the bleach-fix bath, a special composition-having bleach-fix bath may also be used which is such as a bleach-fix bath comprised of a composition wherein a small amount of a halide such as ammonium bromide is added in addition to an iron (III) ethylenediamintetraacetate complex salt bleaching agent and the foregoing silver halide fixing agent; a bleach-fix bath comprising a large amount of a halide such as ammonium bromide; or a bleach-fix bath of a composition in combination of the iron (III) ethylenediaminetetraacetate complex salt bleaching agent with a large amount of a halide such as ammonium bromide. As the halide, hydrochloric acid, hydrobromic acid, lithium bromide, sodium bromide, potassium bromide, sodium iodide, potassium iodide, ammonium iodide or the like may also be used in addition to the above-mentioned ammonium bromide.

As the foregoing silver halide fixing agent to be contained in the bleach-fix bath, a compound to react with silver halide to form a water-soluble complex salt, which is usually used in fixing, may be used, typical examples of which include thiosulfates such as, e.g., potassium thiosulfate, sodium thiosulfate, ammonium thiosulfate, etc., thiocyanates such as potassium thiocyanate, sodium thiocyanate, ammonium thiocyanate, etc., thiourea, thioether, and the like. These fixing agents are used in an amount of not less than 5 g/liter, or may be used in an amount to a dissolvable extent, but are generally used in the amount range of from 70 g to 250 g/liter.

The bleach-fix bath may contain various pH buffers such as boric acid, borax, sodium hydroxide, potassium hydroxide, sodium carbonate, potassium carbonate, sodium hydrogencarbonate, potassium hydrogencarbonate, acetic acid, sodium acetate, ammonium hydroxide, and the like. These may be used alone or in combination of two or more thereof. The bleach-fix bath may also contain various brightening agents or surface active agents, and may further contain arbitrarily preservatives such as hydrogensulfite addition products of hydroxylamine, hydrazine and aldehyde compounds organic chelating agents such as aminopolycarboxylic acids, stabilizers such as nitro alcohol, nitrates, etc., and organic solvents such as methanol, dimethylsulfonamide, dimethylsulfoxide, and the like.

The bleach-fix bath to be used in this invention may also contain any of those various bleaching accelerating agents as described in Japanese Patent O.P.I. Publication No. 280/1976, Japanese Patent Examined Publication Nos. 8506/1970 and 556/1971, Belgian Patent No. 770,910, Japanese Patent Examined Publication Nos. 8836/1970 and 9854/1978, and Japanese Patent O.P.I. Publication Nos. 71634/1979 and 42349/1974.

The bleach-fix bath is used at a pH of not less than 4.0, generally in the pH range of from 5.0 to 9.5, preferably from 6.0 to 8.5, and most preferably from 6.5 to 8.5. The bleach-fix processing takes place at a temperature of not more than 80° C., or more than 3° C. lower, preferably more than 5° C. lower than the color developer solution's temperature, and is desirable to take place at a temperature of not more than 55° C. with its loss by evaporation being restrained.

The bleach-fix processing time is within 90 seconds, and preferably within 60 seconds.

The color photographic light-sensitive material, after being subjected to color development and bleach-fix bath processing, needs to have the disused chemicals remaining thereinside removed therefrom by washing, but instead of the washing, may be subjected to a washing-substitution stabilizing treatment like those as described in Japanese Patent O.P.I. Publication Nos. 14834/1983, 105145/1983, 134634/1983 and 18631/1983, and Japanese Patent Application Nos. 2709/1983 and 89288/1984.

In the case where the color developer, bleach-fix and stabilizer solutions are used for processing while being continuously replenished by appropriate replenishers, the replenishing ration of each replenisher is from 100 to 1000 ml per $m^2$ of a color light-sensitive material, and perferably from 150 to 500 ml.

Example-1

Silver chlorobromide emulsions and a silver chloride emulsion as shown below were prepared in accordance with the double jet process.

| Emulsion No. | grain size (μm) | Silver chloride content (mol %) |
|---|---|---|
| Em-A (comparative) | 0.5 | 20 |
| Em-B (comparative) | 0.5 | 50 |
| Em-C (invention) | 0.5 | 90 |
| Em-D (invention) | 0.5 | 95 |
| Em-E (invention) | 0.5 | 100 |
| Em-F (invention) | 0.8 | 95 |

Each of the above Emulsions Em-A through -F was chemically sensitized by adding thereto chloroauric acid in an amount of $5\times10^{-5}$ mole per mole of silver halide and sodium thiosulfate in an amount of 2 mg per mole of silver halide. Emulsion Em-F was spectrally sensitized by using the following Sensitizing Dye A-1 and was regarded as Blue-Sensitive Emulsion-1 to be used hereinafter. Emulsion Em-D was spectrally sensitized by using the following Sensitizing Dye A-2 and was regarded as Green-Sensitive Emulsion-1. And Emulsions Em-A through Em-E were spectrally sensitized by using the following Sensitizing Dye A-3, whereby Red-Sensitive Emulsions-1 through -5 were obtained.

Sensitizing Dye A-1

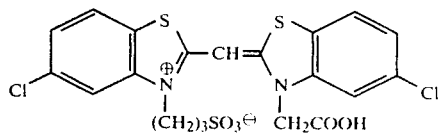

Sensitizing Dye A-2

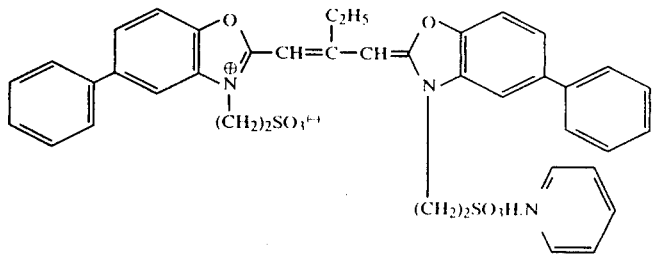

-continued

Sensitizing Dye A-3

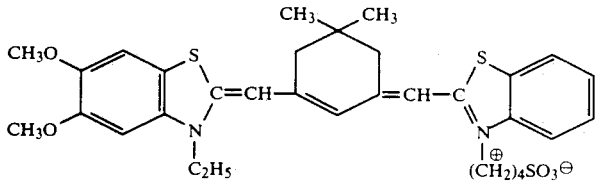

On a polyethylene-coated paper support were coated the following Layer 1 and Layer 2, whereby monochromatic light-sensitive material Samples No. 1 through No. 22.

Layer 1: Red-sensitive emulsion layer

The emulsion was coated so that its constituents' respective coating weights are as follows: the above Red-Sensitive Emulsions-1 through -5 each . . . 2.5 mg/dm$^2$ in silver equivalent, the following Cyan Coupler C-1 . . . 1 mg/dm$^2$, Cyan Coupler C-2 . . . 3 mg/dm$^2$, High-Boiling Organic Solvent S-1 . . . 2 mg/dm$^2$, [S] Compound or its comparative compound given in the following Table-1 . . . $1.5\times10^{-4}$ mole/mol of AgX, the following Water-Soluble Dye-1 . . . 0.1 mg/dm$^2$, Water-Soluble Dye-2 . . . 0.05 mg/dm$^2$, gelatin . . . 14 mg/dm$^2$, and the following Hardener H-1 . . . 0.05 mg/dm$^2$.

Layer 2: Protective layer

The protective layer was coated so that its constituents' coating weights are: the compounds having Formulas I through IV given in Table-1 each . . . $5\times10^{-7}$ mole/dm$^2$, gelatin . . . 20 mg/dm$^2$ and Hardener H-1 . . . 1 mg/dm$^2$.

Cyan Coupler C-1

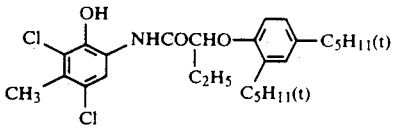

Cyan Coupler C-2

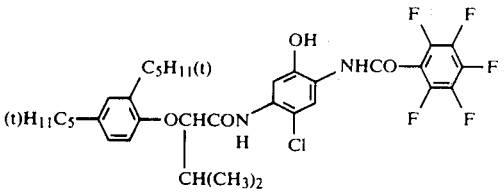

High-Boiling Organic Solvent S-1

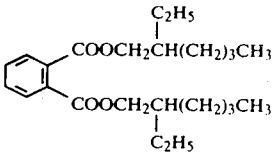

Water-Soluble Dye-1

-continued

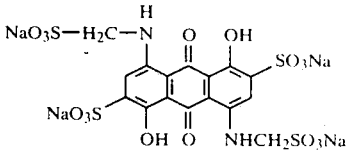

Water-Soluble Dye-2

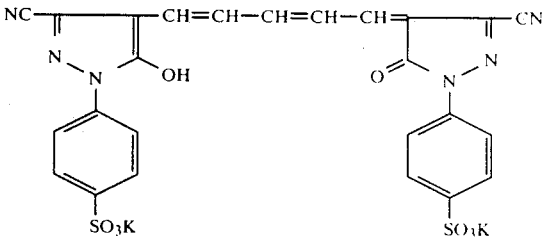

Hardener H-1

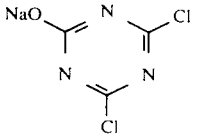

The above-prepared samples each in part was exposed through an optical wedge by using a sensitometer KS-7 (Konishiroku Photo Industry Co., Ltd.) and in part remained unexposed, and then both parts were processed in the following procedure steps:

| Processing Steps | Temperature | Time |
|---|---|---|
| Color developing | 34.7 ± 0.3° C. | 50 seconds |
| Bleach fix | 34.7 ± 0.3° C. | 50 seconds |
| Stabilizing | 30 – 34° C. | 90 seconds |
| Drying | 60 – 80° C. | 60 seconds |

Color Developer Solution:

| | |
|---|---|
| Pure water | 800 ml |
| Ethylene glycol | 10 ml |
| N,N-diethylhydroxylamine | 10 g |
| Potassium chloride | 2 g |
| Potassium sulfite | 0.1 g |
| N-ethyl-N-β-methansulfonamidoethyl-3-methyl-4-aminoaniline sulfate | 5 g |
| Sodium tetrapolyphosphate | 2 g |
| Potassium carbonate | 30 g |
| Brightening agent (4,4'-diaminostilbendisulfone derivative) | 1 g |
| Water to make 1 liter. Adjust the pH to 10.8. | |

Bleach-Fix Bath:

| | |
|---|---|
| Ferric-ammonium ethylenediaminetetraacetate, dihydrated | 60 g |
| Ethylenediaminetetraacetic acid | 3 g |
| Ammonium thiosulfate (aqueous 70% solution) | 100 ml |
| Ammonium sulfite (aqueous 40% solution) | 27.5 ml |
| Adjust the pH to 7.1, and then add water | |

-continued

| | |
|---|---|
| to make 1 liter. | |
| Stabilizer bath | |
| 5-Chloro-2-methyl-4-isothiazoline-3-one | 1 g |
| 1-Hydroxyethylidene-1,1-disulfonic acid | 2 g |
| Water to make 1 liter. Use sulfuric acid or potassium hydroxide to adjust the pH to 7.0. | |

hydroxide to adjust the pH to 7.0.

The above exposed and unexposed samples were subjected to the following characteristics tests. Their results are collectively given in Table-1.

(1) Sensitometry:

Each exposed sample, after being processed as in the above, was subjected to sensitometric measurement by using a densitometer PDA-65 (manufactured by Konishiroku Photo Industry Co., Ltd.) to thereby find its photographic speed and fog values. The photographic speed of each sample is shown in the table in a relative speed to the speed of Sample No. 5 regarded as 100. The fog value was found by processing each sample in the same manner except extending the color developing time alone to 90 seconds.

(2) Mold/Bacteria Resistance Test:

The evaluation method described in Japanese Patent O.P.I. Publication No. 226343/1984 was used as a method for evaluating the improvement effect of the compounds having Formulas I to IV according to this invention.

The test results of these compounds in the example are as given in the following table.

| | Number of molds per ml |
|---|---|
| I-1 | 0 |
| I-4 | 0 |
| II-2 | 0 |
| III-1 | 0 |
| IV-1 | 0 |
| IV-3 | 0 |
| IV-8 | 0 |
| None | $2 \times 10^7$ |
| Phenol | $4 \times 10^7$ |

TABLE 1

| Sample No. | Layer 1 EM | Layer 1 AgCl ratio | Layer 1 [S] Compound | Layer 2 Compound I to IV | Relative speed | Fog | |
|---|---|---|---|---|---|---|---|
| 1 | 1' | 20 | — | — | 62 | 0.06 | Comp. |
| 2 | 1' | 20 | SA-7 | — | 48 | 0.05 | Comp. |
| 3 | 1' | 20 | — | IV-1 | 62 | 0.06 | Comp. |
| 4 | 1' | 20 | SA-7 | IV-1 | 46 | 0.06 | Comp. |
| 5 | 5 | 100 | — | — | 100 | 0.08 | Comp. |
| 6 | 5 | 100 | SA-7 | — | 99 | 0.05 | Comp. |
| 7 | 5 | 100 | — | IV-1 | 92 | 0.09 | Comp. |
| 8 | 5 | 100 | SA-7 | IV-1 | 100 | 0.05 | Inv. |
| 9 | 4 | 95 | SA-7 | IV-1 | 101 | 0.05 | Inv. |
| 10 | 3 | 90 | SA-7 | IV-1 | 100 | 0.05 | Inv. |
| 11 | 2 | 50 | SA-7 | IV-1 | 69 | 0.06 | Comp. |
| 12 | 5 | 100 | SB-1 | IV-1 | 99 | 0.05 | Inv. |
| 13 | 5 | 100 | SC-30 | IV-1 | 100 | 0.05 | Inv. |
| 14 | 5 | 100 | SC-39 | IV-1 | 99 | 0.05 | Inv. |
| 15 | 5 | 100 | SD-5 | IV-1 | 101 | 0.05 | Inv. |
| 16 | 5 | 100 | SD-5 | I-1 | 102 | 0.05 | Inv. |
| 17 | 5 | 100 | SD-5 | I-4 | 100 | 0.05 | Inv. |
| 18 | 5 | 100 | SD-5 | II-2 | 101 | 0.06 | Inv. |
| 19 | 5 | 100 | SD-5 | III-1 | 99 | 0.05 | Inv. |
| 20 | 5 | 100 | SD-5 | IV-3 | 101 | 0.05 | Inv. |
| 21 | 5 | 100 | SD-5 | IV-8 | 100 | 0.05 | Inv. |
| 22 | 5 | 100 | Comparative-1 | IV-8 | 85 | 0.07 | Comp. |

Note: Comp.: Comparative. Inv.: Invention

The structural formula and the solubility product (Ksp) with silver ions of the compound Comparative-1 that was used for comparison with [S] Compound, and the solubility product (Ksp) with silver ions of each [S] Compound are as follows:

Comparative-1

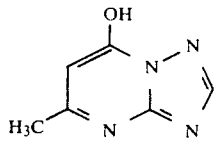

$Ksp = 3.0 \times 10^{-11}$

| | |
|---|---|
| SA-7 | $Ksp = 2.1 \times 10^{-14}$ |
| SB-1 | $Ksp = 1.0 \times 10^{-17}$ |
| SC-30 | $Ksp = 1.9 \times 10^{-12}$ |
| SC-39 | $Ksp = 5.2 \times 10^{-13}$ |
| SD-5 | $Ksp = 3.4 \times 10^{-16}$ |

As is apparent from the results given in Table-1, Samples 1 through 4 and 11, whose each Layer-1 uses a non-invention emulsion, show that their aptitude for the foregoing rapid processing is poor, thus having low photographic speeds.

On the other hand, as for Samples 5 through 8, whose each emulsion is for this invention, Sample 7, to which was added Compound IV-1, shows the deterioration of its photographic speed and increase in fog. In contrast, Sample 8, which is one prepared by adding a compound whose Ksp is within the range specified in this invention to Sample 7, shows being substantially free from the above deterioration of photographic speed and fog—this obviously shows a surprising effect by comparison with the fact that Samples 2 and 6 are lower in the photographic speed than Samples 1 and 5, respectively.

Further, by comparison between Samples 4, 11, 10, 9 and 8, it is apparent that where the silver chloride ratio is low, no sufficient photographic speed can be obtained in rapid processing.

Also, Sample 22, which used a compound whose Ksp is out of the range specified in this invention, shows that it is inadequate in respect of its photographic speed and fog.

From the above results and the mold/bacteria test results it is apparent that the samples of this invention alone show that they are restrained from the speed decline and fog even in rapid processing, and further prevented well from the rottenness or decomposition due to bacteria or mold.

Example-2

Using the Blue-Sensitive Emulsion-1, Green-Sensitive Emulsion-1 and Red-Sensitive Emulsion-5, which were prepared in Example-1, the following respective layers were coated on a polyethylene-coated paper support in the described order from the support side, whereby multi-color light-sensitive photographic materials Samples No. 23 through No. 26 were prepared.

Layer 1: Blue-sensitive emulsion layer

The layer was coated so that its constituents have the following coating weights: the yellow coupler as shown in Table 2 . . . 8 mg/dm$^2$, Blue-Sensitive Emulsion-1 . . . 3 mg/dm$^2$ in silver equivalent, High-Boiling Organic Solvent S-2 . . . 3 mg/dm$^2$, and gelatin . . . 16 mg/dm$^2$.

Layer 2: Intermediate layer

The layer was coated so that the coating weight of Hydroquinone Derivative HQ-1 is 0.45 mg/dm$^2$ and of gelatin is 10 mg/dm$^2$.

Layer 3: Green-sensitive emulsion layer

The layer was coated so that its constituents have the following coating weights: the magenta coupler given in Table-2 . . . in coating weight as shown in Table-2, Water-Soluble Dye-3 . . . 0.1 mg/dm$^2$, Green-Sensitive Emulsion-1 . . . 3.5 mg/dm$^2$ in silver equivalent, High-Boiling Solvent S-1 . . . 4 mg/dm$^2$, and gelatin . . . 16 mg/dm$^2$.

Layer 4: Intermediate layer

The layer was coated so that its constituents have the following coating weights: Ultraviolet Absorbing Agent UV-1 . . . 3 mg/dm$^2$ and UV-2 . . . 3 mg/dm$^2$, High-Boiling Organic Solvent S-2 . . . 4 mg/dm$^2$, Hydroquinone Derivative HQ-1 . . . 0.45 mg/dm$^2$, and gelatin . . . 14 mg/dm$^2$.

Layer 5: Red-sensitive emulsion layer

The layer was coated so that its constituents have the following coating weights: Cyan Coupler C-1 . . . 1 mg/dm$^2$ and C-2 . . . 3 mg/dm$^2$, High-Boiling Organic Solvent S-1 . . . 2 mg/dm$^2$, Red-Sensitive Emulsion-5 . . . 2.5 mg/dm$^2$ in silver equivalent, Water-Soluble Dye-1 . . . 0.1 mg/dm$^2$, Water-Soluble Dye-2 . . . 0.05 mg/dm$^2$, SB-5 as [S] compound . . . $1.5\times10^{-4}$ mole per mole of AgX and gelatin . . . 14 mg/dm$^2$.

Layer 6: Intermediate layer

The layer was coated so that its constituents have the following coating weights: Ultraviolet Absorbing Agent UV-1 . . . 2 mg/dm$^2$ and UV-2 . . . 2 mg/dm$^2$, High-Boiling Organic Solvent S-2 . . . 2 mg/dm$^2$, and gelatin . . . 6 mg/dm$^2$.

Layer 7: Protective layer

The layer was coated so that the coating weight of Fungicide IV-2 is $5\times10^{-7}$ mole/dm$^2$ and of gelatin is 9 mg/dm$^2$.

Further, Sample 27 was obtained in the same manner as in Sample 23 except that no [S] Compound was used in its Layer 5.

The above-obtained Samples 23 through 26 each was processed in the same manner as in Example-1 and then evaluated likewise, provided, however, that the photographic speeds of these samples are given in relative values to the speed of Sample 23 regarded as 100, and the relative speed and fog were found with respect to the blue-sensitive layer (B), green-sensitive layer (G) and red-sensitive layer (R). The obtained results are collectively shown in Table 2.

Couplers

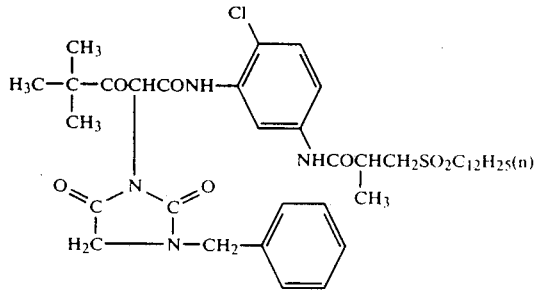

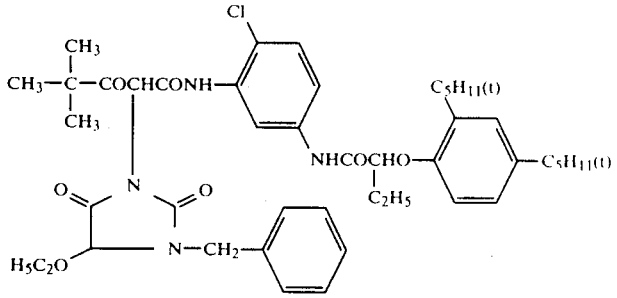

-continued
Y-3
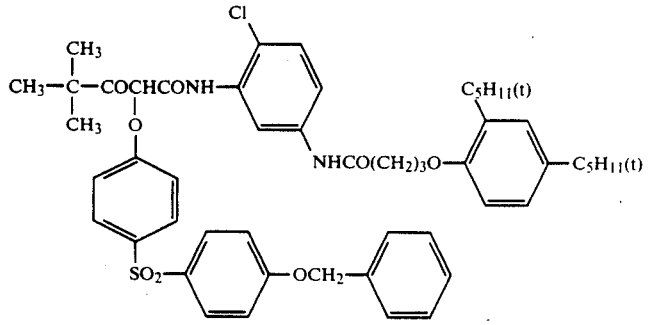
M-1
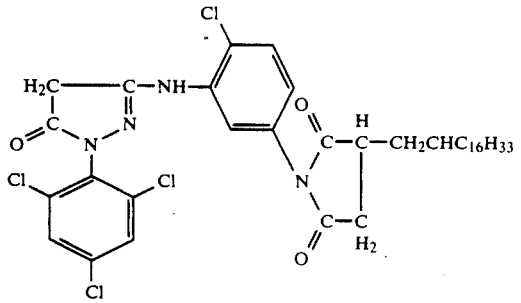
M-2
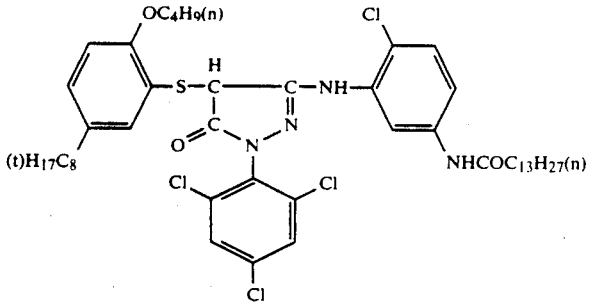
M-3
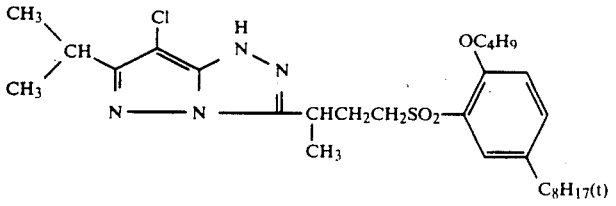
M-4
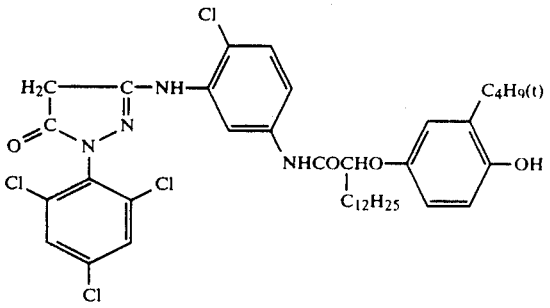
C-3
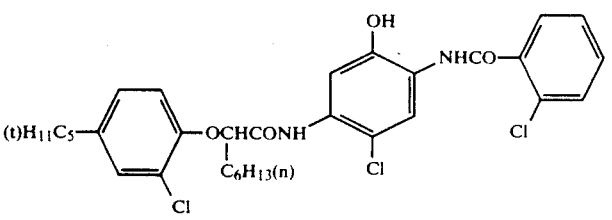

-continued
C-4
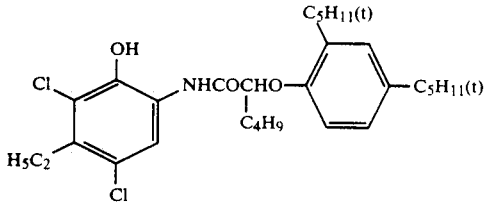
C-5
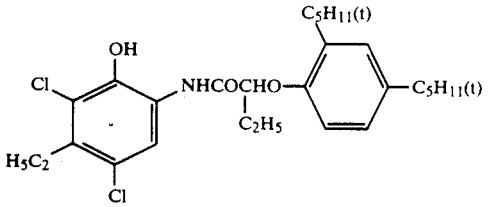
Hydroquinone Derivative HQ-1
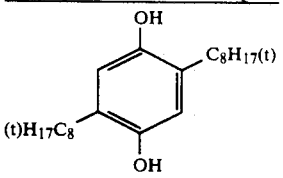
S-2
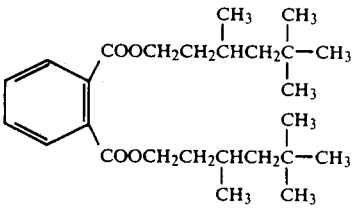
UV-1
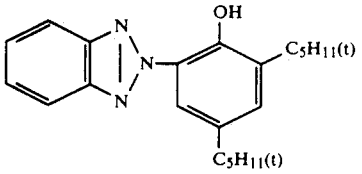
UV-2
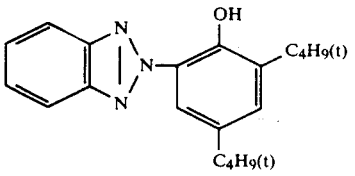
Water-Soluble Dye-3
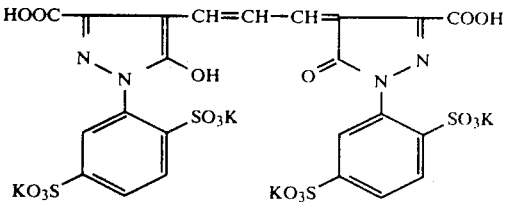
TABLE 2
| Sample No. | Layer 1 Y Coupler | Layer M Coupler | Layer Coated Wt (mg/dm$^2$) | Layer 5 C Coupler | Relative speed B | Relative speed G | Relative speed R | Fog B | Fog G | Fog R |
|---|---|---|---|---|---|---|---|---|---|---|
| 23 | Y-1 | M-1 | 3.5 | C-1<br>C-2 | 100 | 100 | 100 | 0.05 | 0.05 | 0.05 |
| 24 | Y-2 | M-2 | 2.0 | C-1 | 97 | 95 | 100 | 0.05 | 0.05 | 0.05 |

TABLE 2-continued

| Sample No. | Layer 1 Y Coupler | Layer M Coupler | Layer Coated Wt (mg/dm²) | Layer 5 C Coupler | Relative speed B | Relative speed G | Relative speed R | Fog B | Fog G | Fog R |
|---|---|---|---|---|---|---|---|---|---|---|
| | | | | C-3 | | | | | | |
| 25 | Y-1 | M-3 | 2.0 | C-4 | 100 | 98 | 100 | 0.05 | 0.05 | 0.05 |
| | | | | C-3 | | | | | | |
| 26 | Y-3 | M-4 | 3.5 | C-5 | 97 | 100 | 101 | 0.05 | 0.05 | 0.05 |
| 27 (Comp.) | Y-1 | M-1 | 3.5 | C-1 | 100 | 100 | 92 | 0.05 | 0.06 | 0.09 |
| | | | | C-2 | | | | | | |

As is apparent from the results shown in Table-2, the effect of this invention can be obtained likewise even in the multilayer-coated samples wherein couplers are variously changed.

What is claimed is:

1. A silver halide photographic light-sensitive material comprising a support having thereon a photographic constituent layer including at least one silver halide emulsion layer, wherein said silver halide emulsion layer contains silver halide grains of which silver chloride is present in an amount not less than 90 mole %, and said photographic constituent layer contains at least one first compound in an amount of $1\times10^{-6}$ to $1\times10^{-1}$ mole per mole of the silver halide contained in said emulsion layer selected from organic compounds capable of forming a compound having a solubility product Ksp of not more than $1\times10^{-11}$ with a silver ion, and at least one second compound in an amount of $5\times10^{-7}$ to $2\times10^{-3}$ mole per square meter selected from the group consisting of the compounds having the following Formula I, II, III and IV:

Formula I

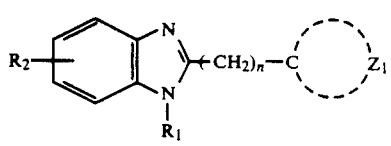

wherein $R_1$ represents a hydrogen atom, an alkyl group or an aryl group; $R_2$ represents a hydrogen atom, a halogen atom, an alkyl group, an aryl group, a nitro group, a carboxy group, a sulfo group, a sulfamoyl group, a hydroxy group, an alkoxy group or a thiazolyl group; $Z_1$ represents a group of non-metal atoms necessary to complete a thiazoline ring, Formula II

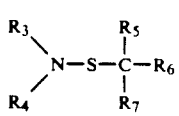

wherein $R_3$ and $R_4$ each independently represents an alkyl group, an aryl group, —COR or

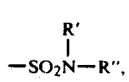

in which R, R' and R'' each independently represents an alkyl group or an aryl group, and $R_3$ and $R_4$ may be combined to form a ring together with the nitrogen atom; and $R_5$, $R_6$ and $R_7$ each independently represents a halogen atom or an alkyl group, Formula III

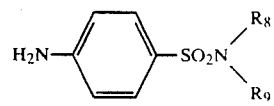

wherein $R_8$ and $R_9$ each independently represents a hydrogen atom, an alkyl group, an aryl group or a nitrogen-containing heterocyclic group, Formula IV

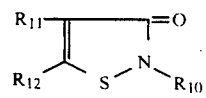

wherein $R_{10}$ represents a hydrogen atom, an alkyl group, a cycloalkyl group, an alkenyl group, an aryl group, a heterocyclic group, an alkylaminocarbonyl group, an arylaminocarbonyl group, an alkylaminosulfonyl group or an arylaminosulfonyl group; $R_{11}$ and $R_{12}$ each independently represents a hydrogen atom, a halogen atom, an alkyl group, a cycloalkyl group, an aryl group, a cyano group, an alkylthio group, an arylthio group, an alkylsulfonyl group, an alkylsulfonyloxy group or a heterocyclic group, provided that the $R_{11}$ and $R_{12}$ may be combined with each other to form a ring.

2. The material of claim 1, wherein said silver chloride content of said silver halide grains is not less than 95 mole %.

3. The material of claim 2, wherein said silver chloride content of said silver halide grains is not less than 99 mole %.

4. The material of claim 1, wherein said silver halide emulsion layer contains said silver halide grains comprising not less than 90 mole % of silver chloride in a ratio of not less than 60% by weight to the total weight of the silver halide grains contained in said silver halide emulsion layer.

5. The material of claim 4, wherein said silver halide emulsion layer contains said silver halide grains having a silver halide content of not less than 90 mole % in a ratio of not less than 80% by weight to the total of the silver halide grains contained in said silver halide emulsion layer.

6. The material of claim 1, wherein said first compound is represented by the following Formula S:

Formula S

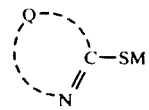

wherein Q represents a group of atoms necessary for completing a five- or six-member heterocyclic ring, or a five- or six-member heterocyclic ring condensed with a benzene ring or a naphthalene ring; and M represents a hydrogen atom or a cation.

7. The material of claim 6, wherein said first compound is selected from the compounds having the following Formula SA, SB, SC or SD:

Formula SA

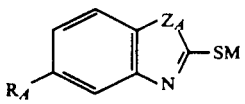

wherein $R_A$ represents a hydrogen atom, an alkyl group, an alkoxy group, an aryl group, a halogen atom, a carboxy group or a salt thereof, a sulfo group or a salt thereof or an amino group; $Z_A$ represents —NH—, —O— or —S—; and M represents a hydrogen atom or a cation, Formula SB

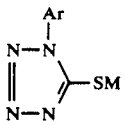

wherein Ar represents

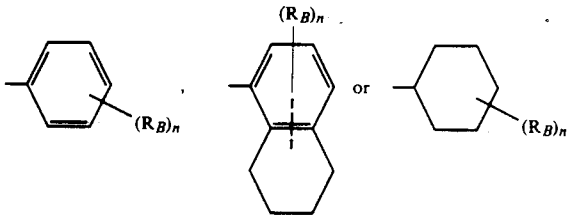

in which $R_B$ represents an alkyl group, an alkoxy group, a carboxy group or a salt thereof, a sulfo group or a salt thereof, a hydroxy group, an amino group, an acylamino group, a carbamoyl group or a sulfonamido group; n represents an integer of 0 to 2; and M is the same as the M defined in Formula SA, Formula SC

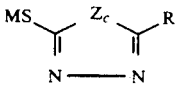

wherein Zc represents a —$NRc_1$— group, an oxygen atom or a sulfur atom; Rc represents a hydrogen atom, an alkyl group, an aryl group, an alkenyl group, a cycloalkyl group, a $SRc_1$ group, an —$NRc_2Rc_3$ group, an —$NHCORc_4$ group, an —$NHSO_2Rc_5$ group or a heterocyclic group, wherein $Rc_1$ represents a hydrogen atom, an alkyl group, an alkenyl group, a cycloalkyl group, an aryl group, a —$CORc_4$ group or an —$SO_2Rc_5$ group, $Rc_2$ and $Rc_3$ each independently represents a hydrogen atom, an alkyl group or an aryl group, $Rc_4$ and $RC_5$ each represents an alkyl group or an aryl group; and M is the same as the M defined in Formula SA, Formula SD

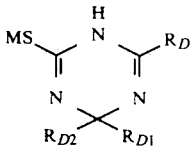

wherein $R_D$, M, $R_{D1}$ and $R_{D2}$ and are the same as the Rc, M, $Rc_1$ and $Rc_2$, respectively, defined in Formula SC.

8. The material of claim 1, wherein said first compound is contained in said silver halide emulsion layer.

9. The material of claim 1, wherein said second compound is contained in a non-light-sensitive layer included in said photographic constituent layer.

10. The material of claim 1, wherein said first compound is contained in said silver halide emulsion layer and said second compound is contained in a non-light-sensitive layer included in said photographic constituent layer.

11. The material of claim 1, wherein said compound having Formula S is contained in said photographic constituent layer in an amount of $1\times10^{-5}$ to $1\times10^{-2}$ mole per mole of the silver halide contained in said silver halide emulsion layer.

12. The material of claim 1, wherein said second compound is contained in said photographic constituent layer in an amount of $5\times10^{-6}$ to $5\times10^{-4}$ mole per square meter.

* * * * *